US006237581B1

(12) United States Patent
Connelly

(10) Patent No.: US 6,237,581 B1
(45) Date of Patent: May 29, 2001

(54) LOW ENERGY TRACK

(76) Inventor: Jerald L. Connelly, 2201 Hercules Dr., Colorado Springs, CO (US) 80906

( * ) Notice: Subject to any disclaimer, the term of this patent is extended or adjusted under 35 U.S.C. 154(b) by 0 days.

(21) Appl. No.: 09/611,430

(22) Filed: Jul. 7, 2000

(51) Int. Cl.[7] ..... F41B 6/00
(52) U.S. Cl. ..... 124/3; 89/8
(58) Field of Search ..... 124/3, 41.1; 89/8; 244/63

(56) References Cited

U.S. PATENT DOCUMENTS 2,485,601 * 10/1949 Hickman ..... 89/8 X
4,840,106 * 6/1989 Jasper, Jr. ..... 124/3 X
5,067,387 * 11/1991 Reynolds ..... 124/3 X
5,155,290 * 10/1992 Hawke ..... 124/3 X

* cited by examiner

*Primary Examiner*—Robert P. Swiatek
(74) *Attorney, Agent, or Firm*—G. F. Gallinger

(57) ABSTRACT

A track useful for guiding a projectile having no wheels along a launching trajectory. The track comprises: an elongate track base extending parallel to the trajectory and a plurality of spaced supporting members, each rotatably carried by the elongate track base. Each supporting member carries an upstanding columnar finger laterally positioned on the supporting member so that a top portion thereof may intersperse with columnar fingers on adjacent supporting members. A projectile seated on a columnar finger will be continuously supported on adjacent columnar fingers as it moves along the trajectory. The supporting members rotate forwardly in turn, first moving to a supporting position perpendicular to the track base, and then, continuing to rotate forwardly, to a lower non-supporting position where the projectile is supported on the next perpendicular columnar finger.

12 Claims, 1 Drawing Sheet

LOW ENERGY TRACK

FIELD OF THE INVENTION

This invention relates to guiding a projectile along a launching trajectory. More particularly this invention relates to a low energy, high strength track adapted to guide a projectile without wheels prior to launching.

BACKGROUND OF THE INVENTION

Tracks are commonly used to guide wheeled vehicles along predetermined routes. They typically are associated with a low maintenance and low energy consumption means of transportation. N.A.S.A. has been experimenting with an electromagnetic track for space shuttle launching. The track comprises a generally level portion to facilitate maximum acceleration and an upwardly curved portion to turn the rapidly moving space shuttle upwardly before its final release. One problem with the electromagnetic track is the extremely high force required to "float" the fast moving shuttle above the track as it is turned upward.

The traditional track cannot be used to launch a vessel which does not have wheels. Neither is the solution of mounting wheels on the track satisfactory. Too much energy is wasted accelerating those wheels. What is needed is a low friction track which does not utilize wheels and which is capable of supporting a great load.

OBJECTS OF THE INVENTION

It is an object of this invention to disclose a low energy track which is capable of guiding an unwheeled projectile. It is yet a further object of this invention to disclose a track which is capable of supporting very high loads so that a fast moving projectile may be turned upwardly on the track. It is a final object of this invention to disclose a track which is both simple and effective.

One aspect of this invention provides for a track for guiding a projectile along a trajectory comprising: an elongate track base extending parallel to the trajectory; a plurality of spaced supporting members, each rotatably carried by the elongate track base; each supporting member carrying an upstanding columnar finger laterally positioned on the supporting member so that a top portion thereof may intersperse with columnar fingers on adjacent supporting members. A projectile seated on a columnar finger will be continuously supported on adjacent columnar fingers as it moves along the trajectory. As the supporting members rotate forwardly in turn, first moving to a supporting position perpendicular to the track base, and then, continuing to rotate forwardly, to a lower non-supporting position where the projectile is supported on the next perpendicular columnar finger.

In a preferred aspect of the invention, the supporting members and the upstanding columnar fingers carried thereon are integrally fabricated from a plate.

Various other objects, advantages and features of this invention will become apparent to those skilled in the art from the following description in conjunction with the accompanying drawings.

FIGURES OF THE INVENTION

Figure 1:
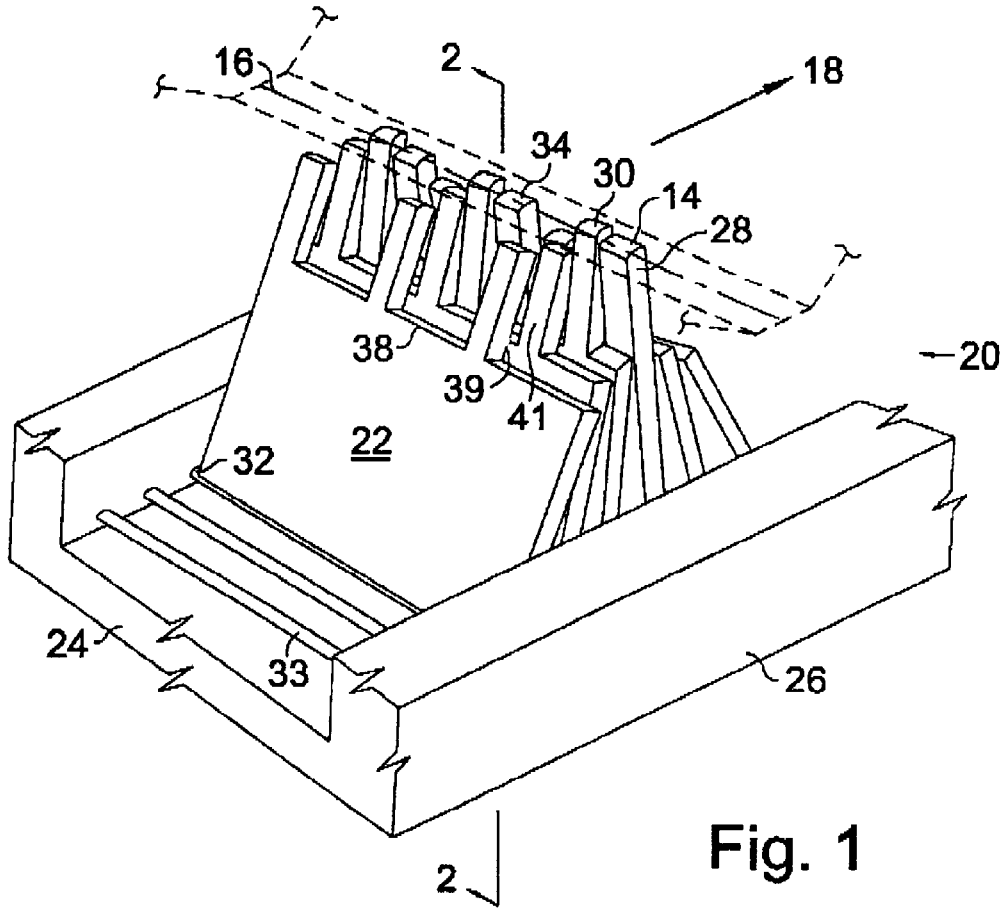
FIG. 1 is a perspective view of a portion of a low energy track having spaced supporting members which are rotatingly carried by the track base and which carry upstanding columnar fingers.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a perspective view of a portion of a low energy track 20 having spaced supporting members 22 rotatingly carried by the track base 24 and which carry upstanding columnar fingers 28. The track 20 is used for guiding a projectile 16 along a trajectory 18. The track 20 comprises: an elongate track base 24 extending parallel to the trajectory 18; lateral alignment means, which preferably are spaced opposite side track portions 26 which extend parallel to the trajectory 18; and, a plurality of spaced supporting members 22, each rotatably carried by opposite side portions 26 of the elongate track base 24. Each supporting member 22 carries an upstanding columnar finger 28 which is laterally positioned on the supporting member 22 so that a top portion 30 thereof may intersperse with columnar fingers 28 on adjacent supporting members 22. A projectile 16 seated on a columnar finger 28 will be continuously supported on adjacent columnar fingers 28 as it moves along the trajectory 18 and as the supporting members 22 rotate forwardly in turn, first moving to a supporting position, perpendicular to the track base 24 and then continuing to rotate forwardly to a lower non-supporting position where the projectile 16 is supported on the next perpendicular columnar finger 28.

Each supporting member 22 generally has the shape of a rectangular plate. In a preferred embodiment of the invention each supporting member 22 and the columnar finger 28 which it carries are integrally fabricated from a single piece of plate. Each columnar finger 28 has a rounded top portion 34. The top portion 34 is rounded generally on a radius extending from a rotational center 32 of the supporting member 22. (It should be noted that in an embodiment of the invention where the supporting member 22 rolls on, rather than rotates in the track base 24, the rotational center 32 would move up on the corresponding supporting member 22 to a midpoint between the bottom portion thereof which is rolling on the track base 24, and a top portion of the columnar finger 28 which is rolling under the projectile 16.) In a preferred embodiment of the invention each supporting member 22 carries three laterally spaced and positioned columnar fingers 28. The columnar fingers on adjacent supporting members are spaced and arranged so that their end portions 34 may be interspersed. Most preferably columnar fingers 28 on any four adjacent supporting members 22 may be interspersed when they are rotated together. When four adjacent supporting members 22 carry columnar fingers 28 which are interspersed, only two different arrangements of supporting members 22 having laterally spaced fingers 28 need be fabricated. These two arrangements may be laterally reversed so that columnar fingers 28 on four adjacent supporting members 22 may be interspersed.

Figure 2:
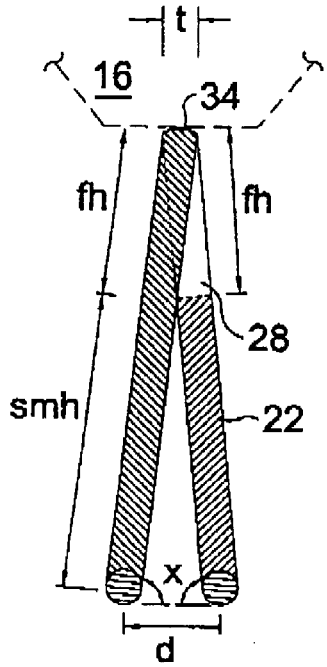
FIG. 2 is a cross sectional view of two supporting members carrying interspersed upstanding columnar fingers as viewed along line 2—2 on FIG. 1.

FIG. 2 is a cross sectional view of two supporting members 22 carrying interspersed upstanding columnar fingers 28 as viewed along line 2—2 on FIG. 1. Most preferably the columnar fingers 28 and support members 22 have a center to center spacing d which marginally exceeds twice their thickness t. This means that the space between any two adjacent supporting members 22 will be marginally greater than the thickness t of a single supporting member 22. If the spacing between supporting members 22 is increased further there is a rougher transition for the projectile 16 resting thereon.

The height of columnar fingers fh and the height of the supporting members smh are arranged so that when two adjacent supporting members 22 are tipped together at equal angles x relative to the track base 24, and the two adjacent supporting members 22 are in contact with each other, a top portion 34 of their columnar fingers 28 are in lateral alignment.

It is contemplated that the supporting members 22 would most preferably have a top side edge portion 38 and that the columnar fingers 28 would most preferably have a front side portion 39 which are faced with a low friction material to reduce friction as one supporting member 22 contacts and lifts the next adjacent supporting member 22 along the trajectory 18. This low friction material may additionally face a rear side portion 41 of the columnar fingers 28 to reduce friction as one supporting member 22 slidingly falls down the rear side portion 41 of the adjacent supporting member 22.

It is contemplated that in order to better carry extreme vertical load that the supporting members 22 roll across a full width of the track base 24. It is further intended that the supporting members 22 be rotatingly carried on the track base 24 either by slipping in a groove 33 extending laterally across the width of the track base 24, or alternatively; by rolling without slipping on the track base 24. The supporting member 22 could be assured to roll without slipping on the track base 24 if interlocking teeth (not shown) were provided between the supporting member 22 and the track base 24.

It is further noted that in order to balance a projectile 16 at least three parallel low energy tracks 20 would be required. There would be at least three supporting points of contact 14 on the projectile 16. One point of contact 14 would be required between the projectile 16 and each of the three parallel low energy tracks 20.

While the invention has been described with preferred specific embodiments thereof, it will be understood that this description is intended to illustrate and not to limit the scope of the invention, which is defined by the following claims.

I claim:

1. A track for guiding a projectile along a trajectory comprising:

an elongate track base extending parallel to the trajectory;

a plurality of spaced supporting members, each rotatingly carried by the elongate track base;

lateral alignment means for maintaining the supporting members in alignment with the track base;

each supporting member carrying an upstanding columnar finger laterally positioned on the supporting member so that a top portion thereof may intersperse with columnar fingers on adjacent supporting members;

so that a projectile seated on a columnar finger will be continuously supported on adjacent columnar fingers as it moves along the trajectory and as the supporting members rotate forwardly in turn first moving to a supporting position perpendicular to the track base and then, continuing to rotate forwardly, to a lower non-supporting position where the projectile is supported on the next perpendicular columnar finger.

2. A track as in claim 1 wherein each supporting member generally has the shape of a rectangular plate.

3. A track as in claim 2 wherein each supporting member and the columnar finger which it carries are fabricated from a plate.

4. A track as in claim 3 wherein the supporting members have a center to center spacing which marginally exceeds twice their thickness.

5. A track as in claim 2 wherein each columnar finger has a rounded top portion, rounded generally on a radius extending from the rotational center of the supporting member.

6. A track as in claim 5 wherein each supporting member carries two laterally spaced and positioned columnar fingers.

7. A track as in claim 5 wherein each supporting member carries three laterally spaced and positioned columnar fingers.

8. A track as in claim 5 wherein top portions of columnar fingers on adjacent supporting members may be interspersed.

9. A track as in claim 5 wherein top portions of columnar fingers columnar fingers on any four adjacent supporting members may be interspersed.

10. A track as in claim 5 wherein the height of columnar fingers and the height of the supporting members are arranged so that when two adjacent supporting members are tipped together at equal angles relative to the track base, and the two adjacent supporting members are in contact with each other, top portions of their columnar fingers are in lateral alignment.

11. A track as in claim 10 wherein the supporting members each have a top side edge portion and the columnar fingers each have a front side portion faced with a low friction material to reduce friction as one supporting member contacts and lifts the next adjacent supporting member along the trajectory.

12. A track as in claim 1 wherein the elongate track base further comprises spaced opposite side portions extending parallel to the trajectory and wherein the lateral alignment means comprises those opposite side portions.

* * * * *